US009022238B2

(12) United States Patent
Bremekamp et al.

(10) Patent No.: US 9,022,238 B2
(45) Date of Patent: May 5, 2015

(54) RAILWAY VEHICLE HAVING FRONT COUPLING COVER

(75) Inventors: Udo Bremekamp, Duisburg (DE); Gerhard Schmidt, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 39 days.

(21) Appl. No.: 13/496,731

(22) PCT Filed: Sep. 16, 2010

(86) PCT No.: PCT/EP2010/063596

§ 371 (c)(1), (2), (4) Date: Mar. 16, 2012

(87) PCT Pub. No.: WO2011/033011

PCT Pub. Date: Mar. 24, 2011

(65) Prior Publication Data

US 2012/0174818 A1 Jul. 12, 2012

(30) Foreign Application Priority Data

Sep. 16, 2009 (DE) ..... 10 2009 041 445

(51) Int. Cl.
*B61D 17/06* (2006.01)

(52) U.S. Cl.
CPC ..... *B61D 17/06* (2013.01)

(58) Field of Classification Search
CPC ..... B61G 7/00; B61G 7/10
USPC ..... 105/238.1, 413; 213/1, 75 R
See application file for complete search history.

(56) References Cited

U.S. PATENT DOCUMENTS

| | | | | |
|---|---|---|---|---|
| 1,821,121 | A | 9/1931 | Stedefeld | |
| 7,191,909 | B2 * | 3/2007 | Heinisch et al. | 213/75 R |
| 8,607,713 | B2 * | 12/2013 | Scholz | 105/413 |
| 2004/0238474 | A1 | 12/2004 | Heinisch et al. | |
| 2009/0321560 | A1 * | 12/2009 | Luce et al. | 244/102 R |
| 2011/0296762 | A1 * | 12/2011 | Ahrens | 49/340 |
| 2013/0042788 | A1 * | 2/2013 | Scholz | 105/413 |
| 2013/0133547 | A1 * | 5/2013 | Heinisch et al. | 105/413 |

FOREIGN PATENT DOCUMENTS

| | | | |
|---|---|---|---|
| CN | 101351372 | A | 1/2009 |
| DE | 472 294 | C | 2/1929 |
| DE | 735 049 | C | 5/1943 |
| DE | 735049 | C | 5/1943 |
| DE | 273 234 | A | 11/1989 |
| DE | 273234 | A | 11/1989 |

(Continued)

OTHER PUBLICATIONS

International Search Report of PCT/EP2010/063596, Dated June 6, 2011.

*Primary Examiner* — Zachary Kuhfuss
(74) *Attorney, Agent, or Firm* — Laurence A. Greenberg; Werner H. Stemer; Ralph E. Locher

(57) ABSTRACT

A railway vehicle has a cover for a front coupling of the railway vehicle. The cover is formed of at least one displaceable front hatch that can be displaced by a drive between an opened and a closed end position. A displacement of the at least one front hatch is guided such that the displacement takes place along a circular segment path about a rotary axis.

3 Claims, 2 Drawing Sheets

(56) References Cited

FOREIGN PATENT DOCUMENTS

| | | | |
|---|---|---|---|
| DE | 94 09 208 | U1 | 7/1995 |
| DE | 273 234 | B5 | 3/1996 |
| DE | 273234 | B5 | 3/1996 |
| DE | 297 06 073 | U1 | 7/1997 |
| EP | 0 686 540 | A1 | 12/1995 |
| EP | 0 826 570 | A2 | 3/1998 |
| EP | 0 870 667 | A2 | 10/1998 |
| EP | 1 350 703 | A1 | 10/2003 |
| EP | 2 208 655 | A1 | 7/2010 |
| JP | 2558830 | Y2 | 1/1998 |
| JP | 2008037386 | A | 2/2008 |
| RU | 2099204 | C1 | 12/1997 |
| WO | 2007/073273 | A1 | 6/2007 |

* cited by examiner

RAILWAY VEHICLE HAVING FRONT COUPLING COVER

BACKGROUND OF THE INVENTION

Field of the Invention

The invention relates to a rail vehicle having a cover for a front coupling of the rail vehicle, wherein the cover is formed by at least one moveable front hatch which can be displaced between an open and a closed end position by means of a drive.

The cover for the front coupling of such a rail vehicle primarily serves visual and aerodynamic purposes. Two front hatches which are arranged one on top of the other are frequently found, said front hatches being displaced where necessary into an open end position with the result that an additional vehicle part can be coupled by means of the front coupling.

Examples of such vehicles from the prior art are the ICE 2 (DB series 402), the ICE 3 (DB series 403/406) and the TGV of the French national railway SNCF.

In all these embodiments of rail vehicles with a cover for its front coupling it is considered disadvantageous that the design of the drive of the front hatch can be regarded as being costly. This also applies to the mounting of the actual front hatch or hatches and the guidance thereof.

BRIEF SUMMARY OF THE INVENTION

Taking this as a basis, the invention is based on the object of simplifying the mounting of the cover in a rail vehicle of the type mentioned at the beginning.

This object is achieved in this rail vehicle in that a movement of the at least one front hatch is guided in such a way that said movement takes place along a circular segment path about a rotary axis.

The movement of the front hatch along a circular segment path has the advantage that simple mounting of the cover for the front coupling of the rail vehicle is brought about and the structure is configured in a simple way.

The rotary axis is preferably arranged horizontally in order to define the movement of the front hatch because in this case it is possible to implement favorable guidance of the rotary movement.

The drive is preferably embodied as a cylinder drive, wherein one side of the cylinder drive is coupled to a bodyshell of the rail vehicle and the other side of the cylinder drive is coupled to the at least one front hatch. Activating the cylinder, which may be, in particular, a pneumatic cylinder, then causes the front hatch to be displaced between the two end positions.

The drive is preferably embodied in self-locking fashion in at least one end position, with the result that the end position which is assumed cannot be readily exited again by the front hatch.

In order to define the movement of the at least one front hatch on a circular path or along a circular path segment it is favorable if the front hatch is guided by means of a guide arm, one end of which is coupled laterally in the front space of the rail vehicle while its other end is connected both to the front hatch and to the drive.

A further front hatch is preferably provided, with the result that the cover of the front coupling is formed by an upper and a lower front hatch which can be mounted in a way such that they correspond to one another. The statements which have been made above with respect to the example of a front hatch apply accordingly to the embodiment of the two front hatches and the drive thereof.

An exemplary embodiment of the invention will be explained in more detail below with reference to the drawing, in which:

DESCRIPTION OF THE INVENTION

Figure 1:
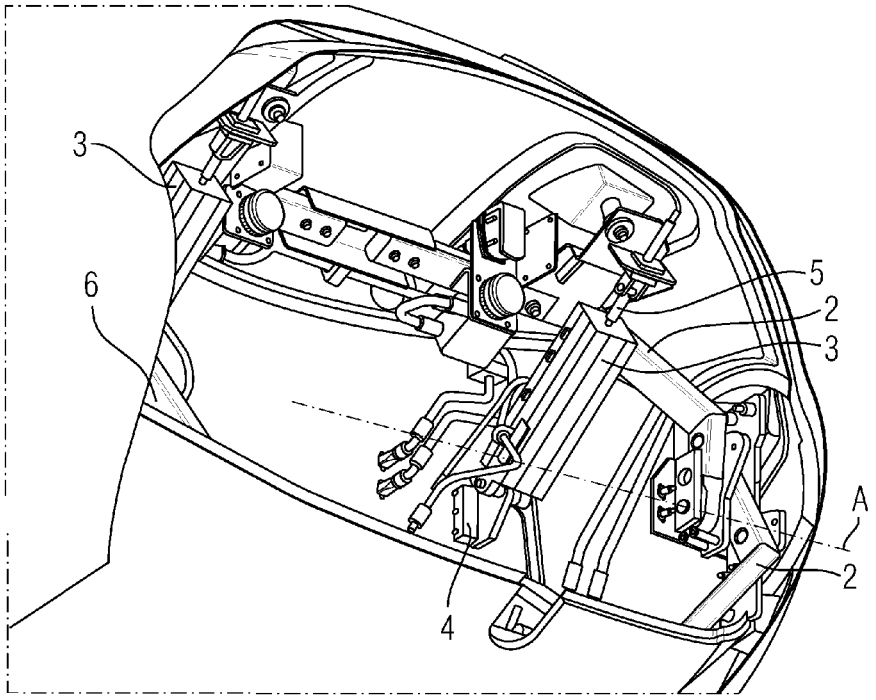
FIG. 1 shows a perspective view of the front nose of FIG. 1 with the front hatches open.

FIG. 1 shows a front nose part of a rail vehicle with an upper front hatch 1 which can be displaced between an open and a closed end position.

The movement of the upper front hatch 1 is determined by a guide arm 2.

The guide arm 2 is rotatably mounted in the lateral region of a front space, specifically about a rotary axis A which defines a purely rotary movement for a movement of the upper front hatch 1. Since the rotary axis A lies in the transverse direction of the rail vehicle or horizontally, the front hatch 1 moves between an upper and a lower position, which respectively correspond to a closed and an open end position.

The pneumatic cylinder 3 is coupled at its bodyshell-side ends to a holder 4. A front coupling (not illustrated), which is, for example, not telescopic, is located inwards of the holder 4 with respect to the vehicle. It is apparent that a piston rod 5 of the pneumatic cylinder 3 is extended completely for the closed end position. In contrast, this piston rod 5 would be retracted for the open end position. Activating the pneumatic cylinder 3 then brings about a displacement of the upper front hatch 1 between the open and the closed end position on a circular path segment which is defined by the rotary axis A.

The pneumatic cylinder 3 is of self-locking design for both end positions.

FIG. 1 also illustrates a further pneumatic cylinder in the lower region, which pneumatic cylinder serves to activate the lower front hatch 6. The pneumatic cylinder for the lower front hatch 6 is mounted in the same way as was explained above with respect to the pneumatic cylinder 3.

Figure 2:
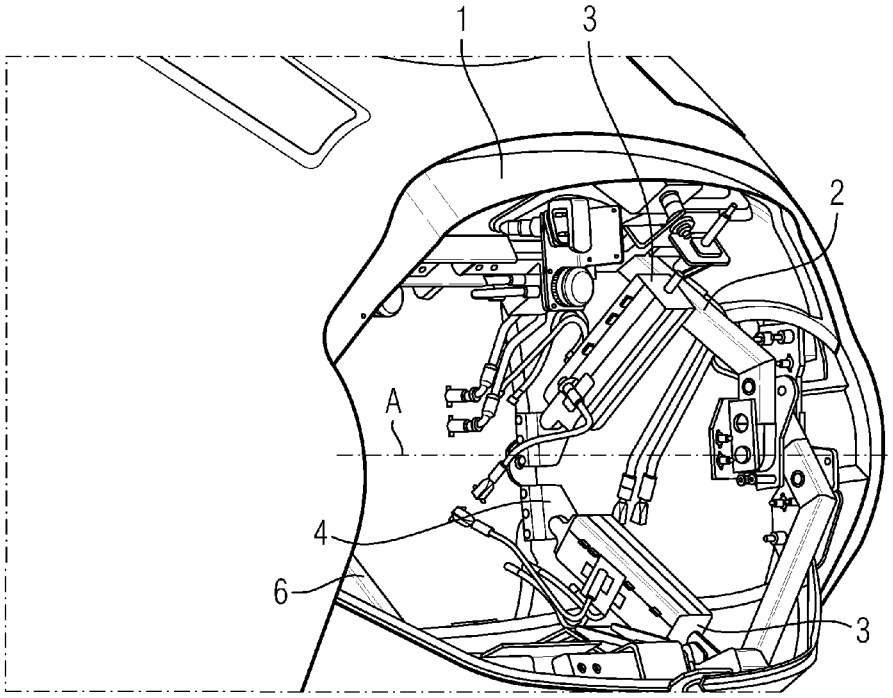
FIG. 2 shows a different perspective view of a front nose of a rail vehicle with the front hatches open.
Figure 3:
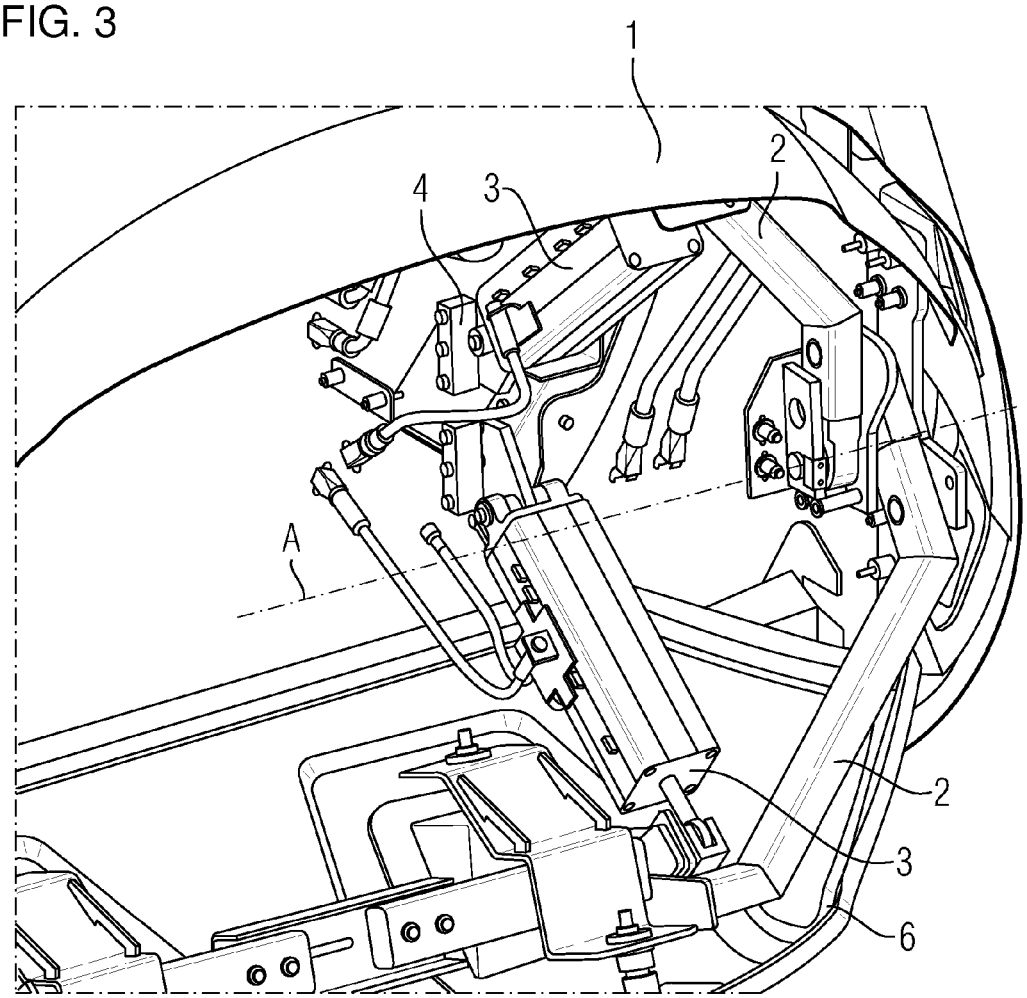
FIG. 3 shows a further perspective view of the front nose from FIG. 1 with the front hatches open.

The various perspective views of FIGS. 2 and 3 illustrate in more detail the arrangement of the components which are described above for activating the front hatches 1, 8. It is therefore clear from FIG. 2 that the upper front hatch 1 is activated by a total of two pneumatic cylinders, wherein the cylinder which is illustrated to the right in FIG. 2 is the pneumatic cylinder 3 which is explained above. For the sake of clarity, in FIGS. 1 to 3 functionally identical components are denoted by the same reference symbols. The two pneumatic cylinders 3 are accommodated to the side in the front space, with the result that a central region thereof remains free in order to permit a coupling process.

From FIG. 2 it is apparent that the lower front hatch 6 is also activated in the same way as the front hatch 1 (explained in more detail above), specifically by means of pneumatic cylinders 3 which are self-locking in their end positions.

FIG. 3 illustrates the right-hand lower region of the front space, wherein, in particular, the coupling of the pneumatic cylinder 3 to the lower front hatch 8 and to the bodyshell side is clearly recognizable.

The invention claimed is:

1. A rail vehicle, comprising:

a front coupling; and a cover for said front coupling, said cover having a drive and two movable front hatches being displaced between an open end position and a closed end position by means of said drive, a movement of said two movable front hatches being guided in each case, such that a displacement takes place along a circular segment path about a horizontally disposed rotary axis such that said two front hatches form an upper and a lower front hatch;

each front hatch of said front hatches having:

a respective guide arm having a first end and a second end;

a body shell;

the movement of said front hatch being guided by means of said guide arm, said first end of said guide arm being coupled in a lateral region of a front space of the rail vehicle such that a central region of said front space remains free to permit a coupling process of said front coupling, and said second end of said guide arm being connected both to said front hatch and said drive; and said drive being a cylinder drive, said cylinder drive having a first side coupled at said body shell and a second side coupled to a respective one of said two movable front hatches.

2. The rail vehicle according to claim 1, wherein said drive is self-locking in at least one end position.

3. The rail vehicle according to claim 1, wherein said upper hatch and said lower hatch are mounted in a way such that they correspond to one another.

* * * * *